US010074905B2

(12) United States Patent
Kim et al.

(10) Patent No.: US 10,074,905 B2
(45) Date of Patent: Sep. 11, 2018

(54) PLANAR ANTENNA APPARATUS AND METHOD

(71) Applicant: Samsung Electronics Co., Ltd., Suwon-si, Gyeonggi-do (KR)

(72) Inventors: Yoon-Geon Kim, Busan (KR); Won-Bin Hong, Seoul (KR); Young-Ju Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/225,779

(22) Filed: Mar. 26, 2014

(65) Prior Publication Data

US 2014/0292601 A1 Oct. 2, 2014

(30) Foreign Application Priority Data

Mar. 26, 2013 (KR) ..... 10-2013-0032017

(51) Int. Cl.
*H01Q 9/04* (2006.01)
*H01Q 21/28* (2006.01)
(Continued)

(52) U.S. Cl.
CPC ..... *H01Q 9/045* (2013.01); *H01Q 1/243* (2013.01); *H01Q 1/48* (2013.01); *H01Q 5/378* (2015.01);
(Continued)

(58) Field of Classification Search
CPC ..... H01Q 9/045; H01Q 5/378; H01Q 21/28
(Continued)

(56) References Cited

U.S. PATENT DOCUMENTS 4,291,311 A 9/1981 Kaloi
5,696,517 A * 12/1997 Kawahata ..... H01Q 1/22 343/700 MS
(Continued)

FOREIGN PATENT DOCUMENTS

CN 101443957 A 5/2009
CN 202513285 U 10/2012
(Continued)

OTHER PUBLICATIONS

Rosu, Iulian "Microstrip, Stripline and CPW Design, YO3DAC/VA3IUL, http://www.gsl.net/va3iul".*

*Primary Examiner* — Dieu H Duong
*Assistant Examiner* — Bamidele A Jegede
(74) *Attorney, Agent, or Firm* — Jefferson IP Law, LLP

(57) ABSTRACT

A planar antenna apparatus is provided. The apparatus includes a first radiation unit configured to transmit a signal, a first feed unit configured to feed a current to the first radiation unit and apply the signal to be transmitted to the first radiation unit, a first Radio Frequency (RF) ground to which a plurality of antenna elements are grounded; and a via that connects the first radiation unit to the first RF ground, wherein all of the first radiation unit, the first feed unit, the first RF ground, and the via are disposed on a first plane, and wherein a capacitance value between the first radiation unit and the first feed unit and an inductance value determined by a length and a width of the radiation unit are set as values that cause a resonant frequency in a specific frequency band to be a preset value.

20 Claims, 16 Drawing Sheets
(4 of 16 Drawing Sheet(s) Filed in Color)

(51) Int. Cl.
*H01Q 5/378* (2015.01)
*H01Q 1/24* (2006.01)
*H01Q 13/10* (2006.01)
*H01Q 1/48* (2006.01)

(52) U.S. Cl.
CPC ..... *H01Q 9/0421* (2013.01); *H01Q 13/106* (2013.01); *H01Q 21/28* (2013.01)

(58) Field of Classification Search
USPC ..... 343/749
See application file for complete search history.

(56) References Cited

U.S. PATENT DOCUMENTS 5,748,149 A * 5/1998 Kawahata ..... H01Q 9/0407 343/700 MS
5,903,240 A * 5/1999 Kawahata ..... H01Q 1/243 343/700 MS
5,959,582 A * 9/1999 Kawahata ..... H01Q 1/243 343/700 MS
6,476,767 B2 * 11/2002 Aoyama ..... H01Q 1/22 343/700 MS
7,245,268 B2 * 7/2007 O'Neill, Jr. ..... H01Q 11/08 343/702
7,450,072 B2 * 11/2008 Kim ..... H01Q 1/243 343/700 MS
7,952,526 B2 5/2011 Lee et al.
8,174,459 B2 5/2012 Chen et al.
2006/0066422 A1 * 3/2006 Itoh ..... H01P 7/082 333/219
2007/0229366 A1 10/2007 Kim et al.
2007/0268191 A1 * 11/2007 Ishizuka ..... H01Q 1/243 343/702
2008/0204327 A1 8/2008 Lee et al.
2008/0224946 A1 * 9/2008 Lee ..... H01Q 1/2283 343/895
2010/0238081 A1 9/2010 Achour et al.
2011/0037675 A1 * 2/2011 Chen ..... H01Q 1/38 343/848
2011/0050505 A1 3/2011 Lim et al.
2011/0133994 A1 6/2011 Korva
2011/0193762 A1 8/2011 Choi et al.
2012/0146865 A1 * 6/2012 Hayashi ..... H01Q 5/392 343/750
2012/0231750 A1 9/2012 Jin et al.
2012/0249386 A1 * 10/2012 Yanagi ..... H01Q 9/42 343/749

FOREIGN PATENT DOCUMENTS

JP 7-235826 A 9/1995
JP 9-219619 A 8/1997
JP 2005-149298 A 6/2005
JP 2007-325118 A 12/2007
JP 2008-54146 A 3/2008
JP 2012-186810 A 9/2012
KR 10-2008-0112502 A 12/2008
KR 10-2009-0016358 A 2/2009
KR 10-2009-0055002 A 6/2009
KR 10-2009-0086218 A 8/2009

* cited by examiner

VERTICAL RADIATION ANTENNA

HORIZONTAL RADIATION ANTENNA

PLANAR ANTENNA APPARATUS AND METHOD

CROSS-REFERENCE TO RELATED APPLICATION(S)

This application claims the benefit under 35 U.S.C. § 119(a) of a Korean patent application filed on Mar. 26, 2013 in the Korean Intellectual Property Office and assigned Serial number 10-2013-0032017, the entire disclosure of which is hereby incorporated by reference.

TECHNICAL FIELD

The present disclosure relates to a planar antenna apparatus and method.

BACKGROUND

Recently, due to the development of wireless communication technology, AllShare™-based data transmission between smart devices has increased. For example, Bluetooth™ and/or Wireless Fidelity (Wi-Fi)-based data transmission/reception between a smart Television (TV) and a terminal has increased. For this purpose, a dedicated antenna is mounted on the terminal and on the TV.

A data reception rate is proportional to a height of an antenna mounted on a TV. In other words, the data reception rate increases as the height of the antenna mounted on the TV increases. Since a TV antenna is typically mounted on a rear of a TV, the TV may be thicker as the height of the antenna increases. However, due to the characteristics of TVs which are getting slimmer, there is a limit to increasing the height of the antenna for the improvement of the data reception rate. Therefore, there is a need for a way to increase the data reception rate regardless of the height of the antenna.

The existing patch antenna can be mounted on a TV because of the antenna's flat shape. Typically, an antenna is mounted on the rear of a TV, and if the patch antenna is mounted on the rear of the TV, most signals radiated from the patch antenna may exist only in the rear of the TV because the patch antenna radiates signals vertically. Therefore, a receiving device situated in front of the TV may not correctly receive the signals transmitted from the TV.

To address these and other problems, a flat-type antenna capable of horizontal radiation needs to be mounted on the TV. A Zeroth-Order Resonator (ZOR) antenna is a typical example of the flat-type antenna. The ZOR antenna is free from the antenna's physical size, and can radiate signals in parallel to the antenna's metal pattern. The ZOR antenna may be implemented by deriving the characteristics of a Left-Handed Material (LHM) having negative permittivity and negative permeability, which do not exist naturally, by modifying the antenna structure, due to the physical constraints of the direction in which radio waves travel in a Right-Handed Material (RHM).

The ZOR antenna may be constructed in, for example, the following three forms. In a first form of the ZOR antenna, a via for connecting a radiator metal pattern printed on the top face of a two-layer substrate to a ground metal pattern on the bottom face thereof is disposed to derive a parallel inductance value of an operating frequency. However, in this structure, a predetermined number of radiator metal patterns existing on a top face of the two-layer substrate need to be arranged in order to make it possible to derive a serial capacitance value and a parallel inductance value, thus, a wider horizontal antenna space is needed. In addition, this structure uses the via for connecting a top plate of the antenna to a bottom plate thereof, causing an increase in a total volume or a form factor. Therefore, with use of the ZOR antenna in the first form, it is hard to design a slim TV.

A second form of the ZOR antenna corresponds to an antenna structure in a Three-Dimensional (3D) form, which has a plurality of faces so that the antenna may operate in multiple bands. In this structure, bandwidth characteristics, which are a drawback of the ZOR antenna, may be improved, contributing to improving antenna performance compared with that of the ZOR antenna in the first form. However, the ZOR antenna in the second form may be hardly mounted on a small wireless device, a TV or the like, since the antenna is not implemented in a normal structure, but in a 3D structure that uses faces of a rectangular parallelepiped, causing limits of a manufacturing process due to the 3D structure.

A third form of the ZOR antenna corresponds to a planar structure in which a ground existing on a bottom face of the ZOR antenna in the first form is disposed on the top face thereof. The ground on the bottom face is disposed on the left and right of the radiator metal pattern, and three independent grounds may exist. The third form may significantly reduce a volume because it implements the antenna in the planar form, unlike the first form and the second form of the ZOR antenna. Therefore, the ZOR antenna in the third form is advantageous in that the antenna can be mounted on small products. However, the third form may have the following problems.

The third form needs a wide horizontal antenna space since the ground situated on the bottom face is disposed on the top face to implement the antenna in the planar form. In addition, the antenna based on the third form may enable slim products due to a thin-film antenna when the thin film antenna is mounted on the products, but the thin film antenna's performance may be distorted or its efficiency may be reduced due to the influence of the metal as the antenna is in close proximity to the products.

Therefore, there is a need for a new antenna that is designed taking into account a cost, mounting, a utility, performance degradation and the like.

The above information is presented as background information only to assist with an understanding of the present disclosure. No determination has been made, and no assertion is made, as to whether any of the above might be applicable as prior art with regard to the present disclosure.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide a planar antenna apparatus and method.

Another aspect of the present disclosure is to provide an antenna apparatus and method in which an antenna has a planar structure, enables horizontal radiation, and can be configured to be ultra-thin.

Another aspect of the present disclosure is to provide an antenna apparatus and method capable of adjusting a radiation direction and extending an antenna bandwidth.

In accordance with an aspect of the present disclosure, a planar antenna apparatus is provided. The apparatus includes a first radiation unit configured to transmit a signal, a first feed unit configured to feed a current to the first radiation unit and apply the signal to be transmitted to the first radiation unit, a first Radio Frequency (RF) ground to which a plurality of antenna elements are grounded, and a via that connects the first radiation unit to the first RF ground, wherein all of the first radiation unit, the first feed unit, the first RF ground, and the via are disposed on a first plane, and wherein a capacitance value between the first radiation unit and the first feed unit and an inductance value determined by a length and a width of the radiation unit are set as values that cause a resonant frequency in a specific frequency band to be a preset value.

In accordance with another aspect of the present disclosure, a method for transmitting a signal is provided. The method includes transmitting a signal using an antenna, wherein the antenna includes a first radiation unit configured to transmit the signal, a first feed unit configured to feed a current to the first radiation unit and to apply the signal to be transmitted to the first radiation unit, a first Radio Frequency (RF) ground to which a plurality of antenna elements are grounded, and a via that connects the first radiation unit to the first RF ground, wherein all of the first radiation unit, the first feed unit, the first RF ground, and the via are disposed on a first plane, and wherein a capacitance value between the first radiation unit and the first feed unit and an inductance value determined by a length and a width of the radiation unit are set as values that cause a resonant frequency in a specific frequency band to be a preset value.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skilled in the art will recognize that various changes and modifications of the embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

An embodiment of the present disclosure provides an antenna in which a serial capacitance and a parallel inductance are formed in a same plane, and that has Zeroth-Order Resonator (ZOR) characteristics. An antenna structure according to an embodiment of the present disclosure is illustrated in FIGS. 1A to 1C.

Figure 1A:
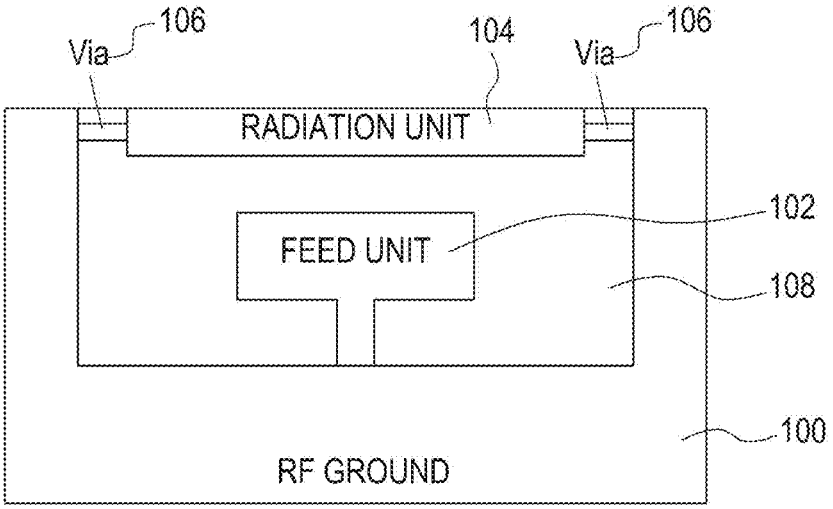
FIGS. 1A, 1B, and 1C illustrate a structure of an antenna according to an embodiment of the present disclosure.
Figure 1B:
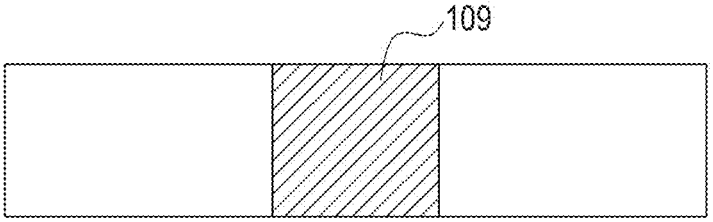
Figure 1C:
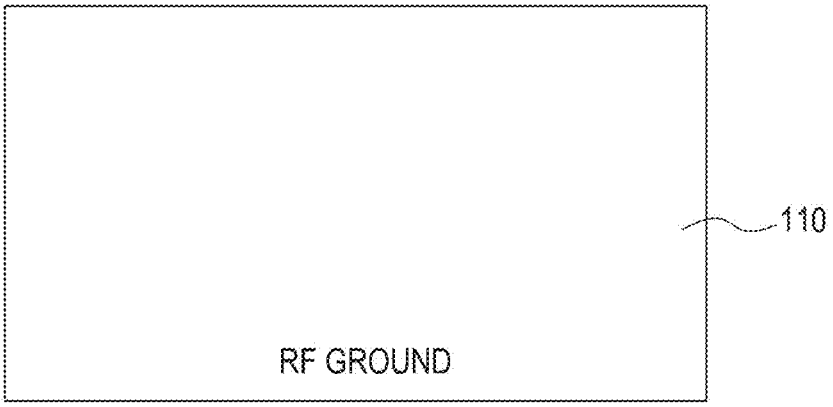

FIGS. 1A to 1C illustrate a structure of an antenna according to an embodiment of the present disclosure.

Referring to FIG. 1A, a top face of the antenna is illustrated. The top face of the antenna has a flat structure, and may include a substrate 108 of a conductive metal pattern, a Radio Frequency (RF) ground 100, a feed unit 102, a radiation unit 104, and at least one via 106.

The RF ground 100, to which a plurality of antenna elements are grounded, may be connected to the radiation unit 104 through the via 106. The feed unit 102 may feed a current to the radiation unit 104, and apply a signal provided from an RF chip to the radiation unit 104. The radiation unit 104 may radiate the signal applied from the feed unit 102. The feed unit 102 and the radiation unit 104 may perform a signal applying operation using an inductive scheme or a capacitive coupling scheme.

A serial capacitance value and a parallel inductance value on an equivalent circuit of the antenna may be determined so that a signal may be radiated horizontally. The serial capacitance value and the parallel inductance value may be determined as values that cause a resonant frequency to be zero in a predetermined frequency band so that they may have ZOR antenna characteristics.

The determined serial capacitance value may be used to determine a separation distance between the feed unit 102 and the radiation unit 104, and the determined parallel inductance value may be used to determine a width and a length of the radiation unit 104. Based on the separation distance between the feed unit 102 and the radiation unit 104 and the width and length of the radiation unit 104, the RF ground 100, the feed unit 102, the radiation unit 104 and the via 106 may be disposed on a top face of the antenna. In this antenna, a signal may be radiated in parallel to the substrate 108.

Referring to FIG. 1B, a side face of the antenna is illustrated. The side face of the antenna may include a connection unit 109 that connects the top face of the antenna to a bottom face thereof. The connection unit 109 may be used to implement a switching function capable of adjusting a radiation direction and/or azimuth of the antenna, and a detailed description thereof will be made later.

Referring to FIG. 1C, the bottom face of the antenna is illustrated. The bottom face of the antenna may be configured in a form in which an RF ground 110 is included. In other words, the bottom face of the antenna may be configured in a form in which the RF ground 100 on the top face may be extended in order to reduce the influence of the metal when the antenna is mounted on a device.

Figure 2:
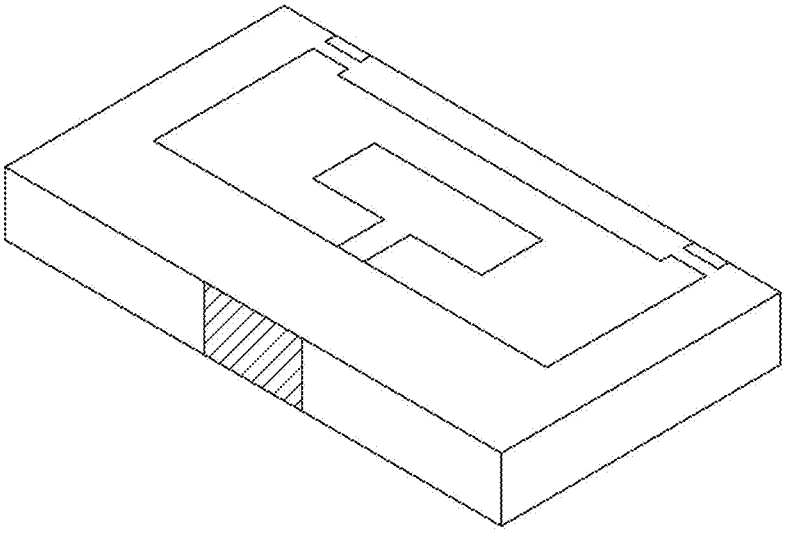
FIG. 2 illustrates an antenna according to an embodiment of the present disclosure.

FIG. 2 illustrates an antenna according to an embodiment of the present disclosure.

Referring to FIG. 2, the antenna having the structures as in FIGS. 1A to 1C may have a structure of a rectangular parallelepiped as illustrated in FIG. 2.

Figure 3:
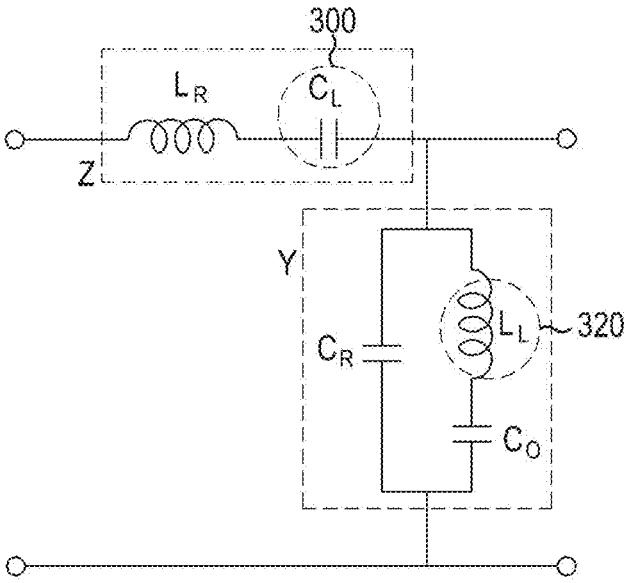
FIG. 3 illustrates an equivalent circuit included in an antenna according to an embodiment of the present disclosure.

FIG. 3 illustrates an equivalent circuit included in an antenna according to an embodiment of the present disclosure.

Referring to FIG. 3, the equivalent circuit may include a serial capacitance $C_L$ 300 and a parallel inductance $L_L$ 320. A resonant frequency of the antenna may be determined depending on values of the serial capacitance $C_L$ 300 and the parallel inductance $L_L$ 320. Therefore, in an embodiment of the present disclosure, the ZOR characteristics having an infinite wavelength may be implemented by adjusting the values of the serial capacitance $C_L$ 300 and the parallel inductance $L_L$ 320 so that the resonant frequency may be zero in a specific frequency band.

In other words, as described before in conjunction with FIG. 1A, the ZOR characteristics may be achieved by adjusting the separation distance between the feed unit 102 and the radiation unit 104 to determine the value of the serial capacitance $C_L$ 300 and by adjusting the width and the length of the radiation unit 104 to determine the value of the parallel inductance $L_L$ 320.

Figure 4A:
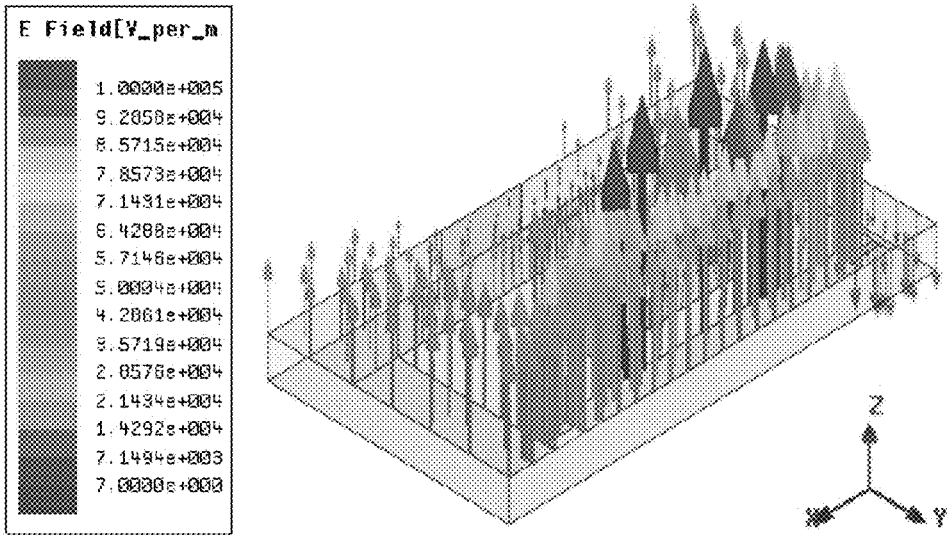
FIGS. 4A and 4B illustrate forms in which a signal is horizontally radiated from an antenna according to an embodiment of the present disclosure.
Figure 4B:
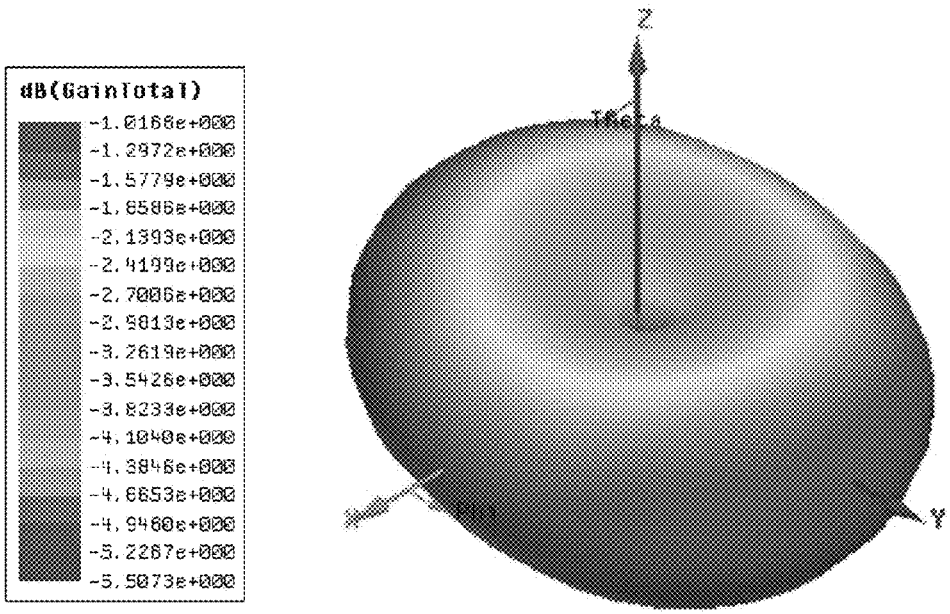

FIGS. 4A and 4B illustrate forms in which a signal is horizontally radiated from an antenna according to an embodiment of the present disclosure.

Referring to FIGS. 4A and 4B, the antenna according to an embodiment of the present disclosure may have a horizontal radiation pattern as illustrated in FIG. 4A, depending on the ZOR characteristics. Specifically, the antenna may have a pattern in which most signals are radiated in the Z-axis direction, as illustrated in FIG. 4B.

Figure 5A:
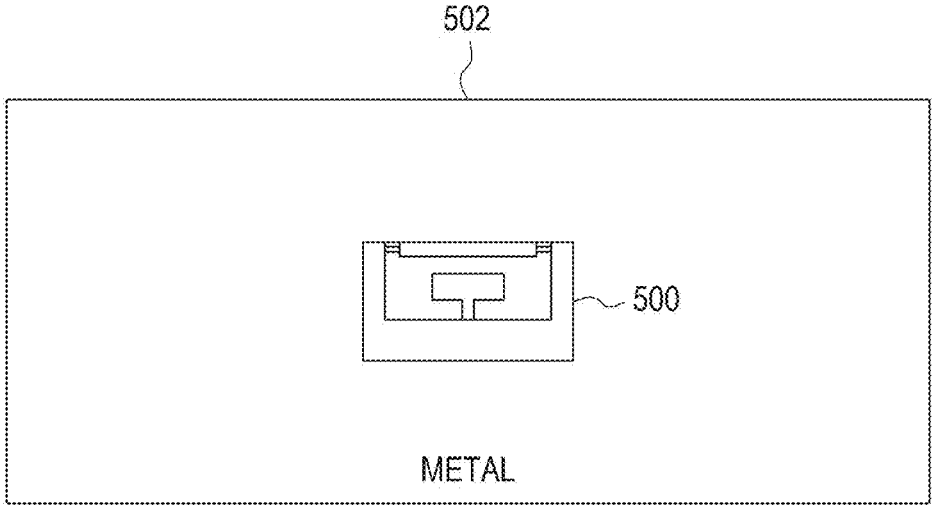
FIGS. 5A and 5B illustrate an antenna mounted on a Television (TV) according to an embodiment of the present disclosure.
Figure 5B:
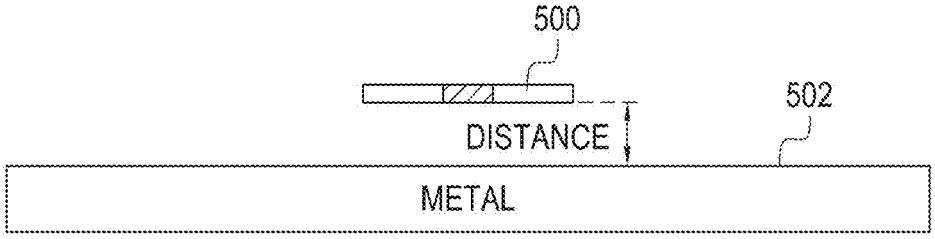

FIGS. 5A and 5B illustrate an antenna mounted on a TV according to an embodiment of the present disclosure.

Referring to FIGS. 5A and 5B, although the antenna is assumed to be mounted on a TV in this embodiment, the antenna may be mounted on the TV and also on other devices capable of wireless communication.

An antenna 500 according to an embodiment of the present disclosure may be mounted on the rear of a TV 502 as illustrated in FIG. 5A. The antenna 500 may be mounted to be spaced apart from the TV 502 by a specific separation distance as illustrated in FIG. 5B, or the antenna 500 may be mounted without the separation distance. A form in which a signal is radiated from the antenna 500 mounted on the TV 502 is illustrated in FIG. 6.

Figure 6:
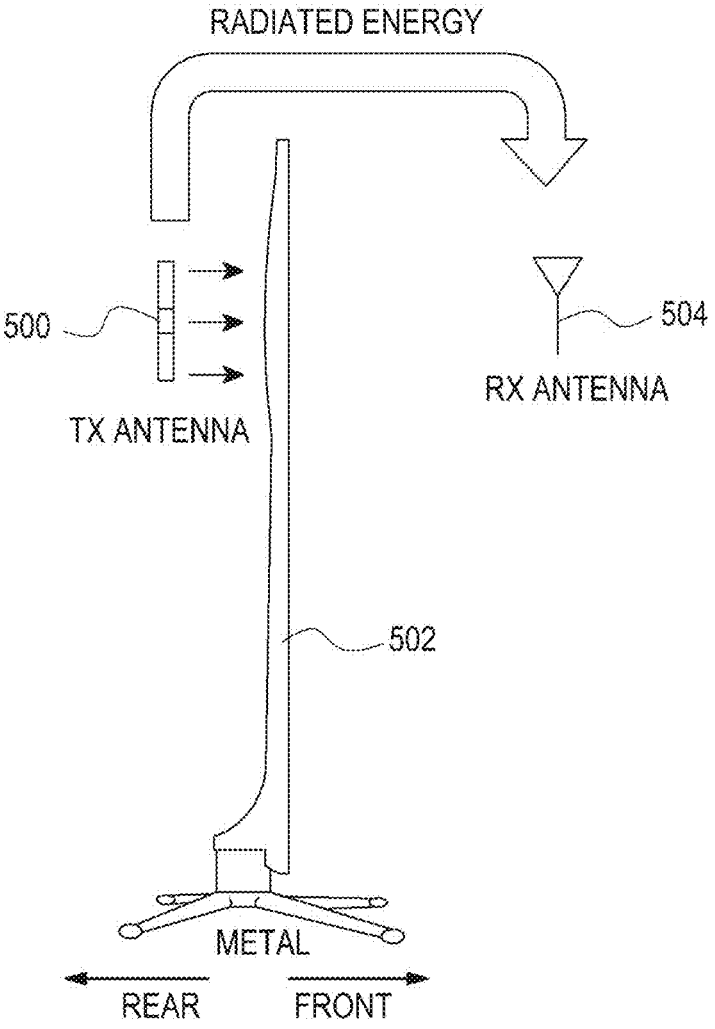
FIG. 6 illustrates a form in which a signal is radiated from an antenna mounted on a TV according to an embodiment of the present disclosure.

FIG. 6 illustrates a form in which a signal is radiated from an antenna mounted on a TV according to an embodiment of the present disclosure.

Referring to FIG. 6, a signal radiated from the antenna 500 attached to and/or mounted on the rear of the TV 502 may be transmitted to a receive antenna 504, which may also be referred to as an RX antenna 504, situated in front of the TV 502. The antenna 500 attached to the rear of the TV 502 may be a horizontal radiation antenna, and a comparison between the horizontal radiation antenna and the existing vertical radiation antenna is illustrated in FIGS. 7A and 7B.

Figure 7A:
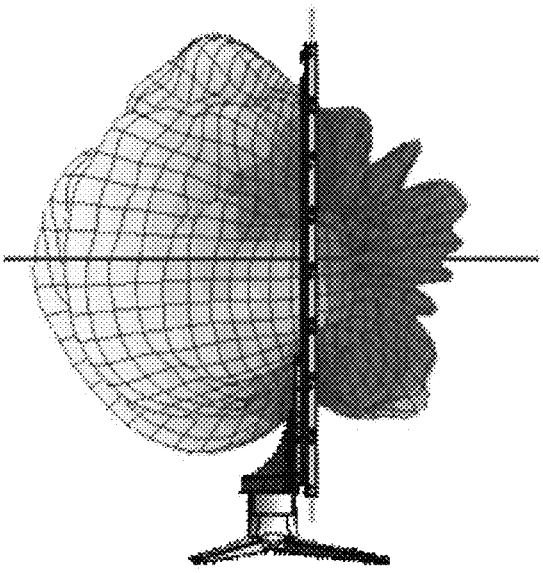
FIGS. 7A and 7B illustrate a comparison between a vertical radiation antenna and a horizontal radiation antenna according to an embodiment of the present disclosure.
Figure 7B:
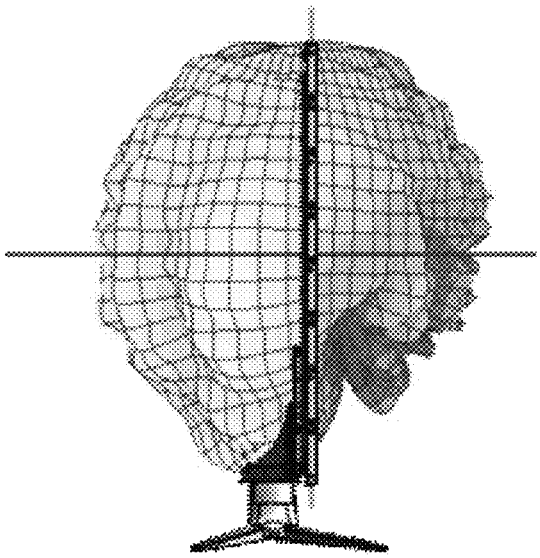

FIGS. 7A and 7B illustrate a comparison between a typical vertical radiation antenna and a horizontal radiation antenna according to an embodiment of the present disclosure.

Referring to FIGS. 7A and 7B, compared with the vertical radiation antennal illustrated in FIG. 7A, the horizontal radiation antenna illustrated in FIG. 7B may radiate more signals toward the front of the TV when it is mounted on the rear of the TV. In other words, the horizontal radiation antenna, compared with the vertical radiation antenna, may have a higher antenna gain, for example, an antenna gain higher by 3 to 7 dB.

Figure 8:
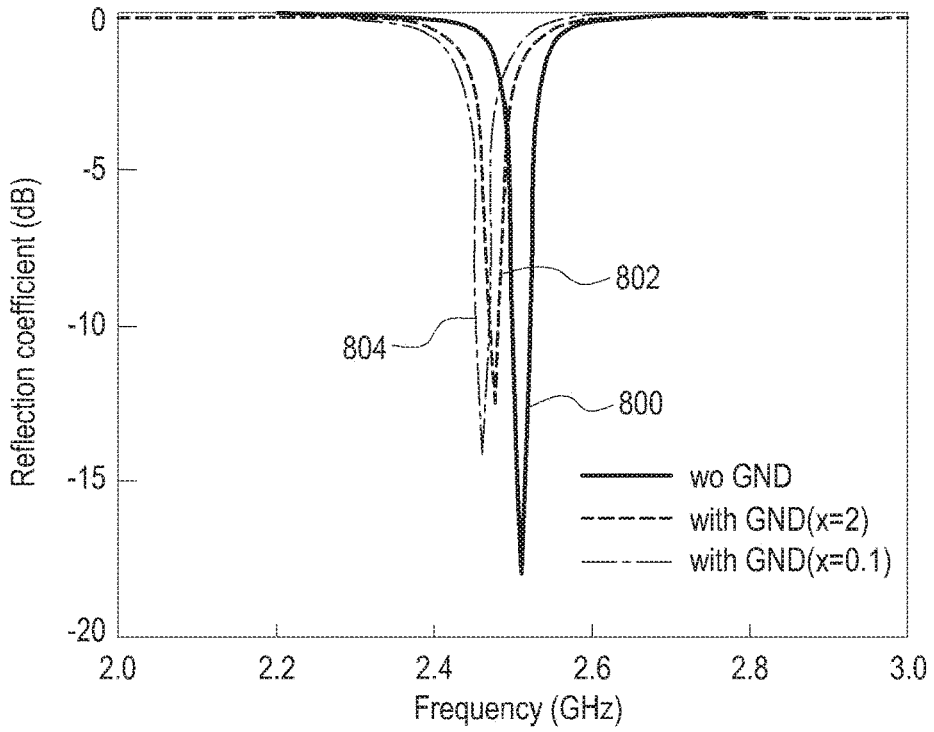
FIG. 8 is a graph illustrating a change in operating frequency based on a distance between a TV and an antenna according to an embodiment of the present disclosure.

FIG. 8 is a graph illustrating a change in operating frequency based on a distance between a TV and an antenna according to an embodiment of the present disclosure.

Referring to FIG. 8, it can be noted that all of a first operating frequency 800 of the antenna before the antenna is mounted on the TV, a second operating frequency 802 of the antenna when the distance between the antenna and the TV is 0.1 mm, and a third operating frequency 804 of the antenna when the distance between the antenna and the TV is 2 mm, may fall within a range of 2.4GHz to 2.6 GHz. Therefore, in an embodiment of the present disclosure, a change in an operating frequency of the antenna may be very small, even though the antenna is mounted in close proximity to the metallic rear of the TV.

Figure 9:
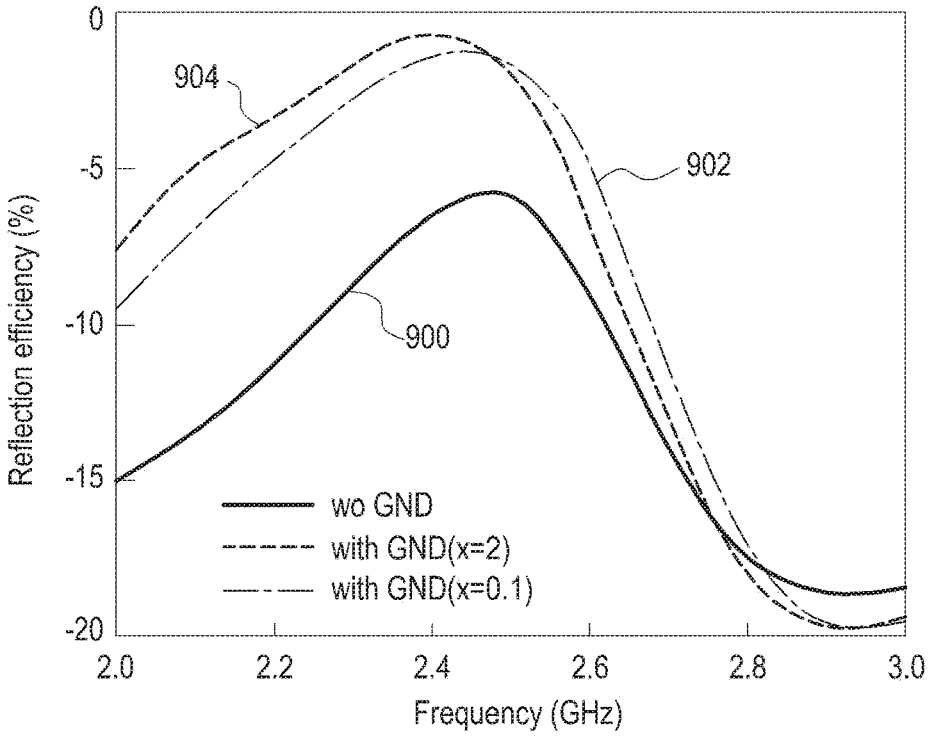
FIG. 9 is a graph illustrating a radiation efficiency based on a distance between a TV and an antenna according to an embodiment of the present disclosure.

FIG. 9 is a graph illustrating a radiation efficiency based on a distance between a TV and an antenna according to an embodiment of the present disclosure.

Referring to FIG. 9, it can be noted that compared with a first radiation efficiency 900 of the antenna before the antenna is mounted on the TV, a second radiation efficiency 902 of the antenna when the distance between the antenna and the TV is 0.1 mm, and a third radiation efficiency 904 of the antenna when the distance between the antenna and the TV is 2 mm may be higher. In other words, in a case of the related-art antenna, the related-art antenna's radiation efficiency is reduced to 20% of the normal radiation efficiency, if the antenna is in close proximity to the metal. However, in a case of the antenna according to an embodiment of the present disclosure, the influence of the metal, which affects the antenna performance, may be significantly reduced, since the RF ground is disposed on the bottom face of the antenna. As a result, the radiation efficiency may be higher as the antenna gets closer to the metal.

The above-described antenna according to an embodiment of the present disclosure may be additionally used in the following various forms.

Figure 10:
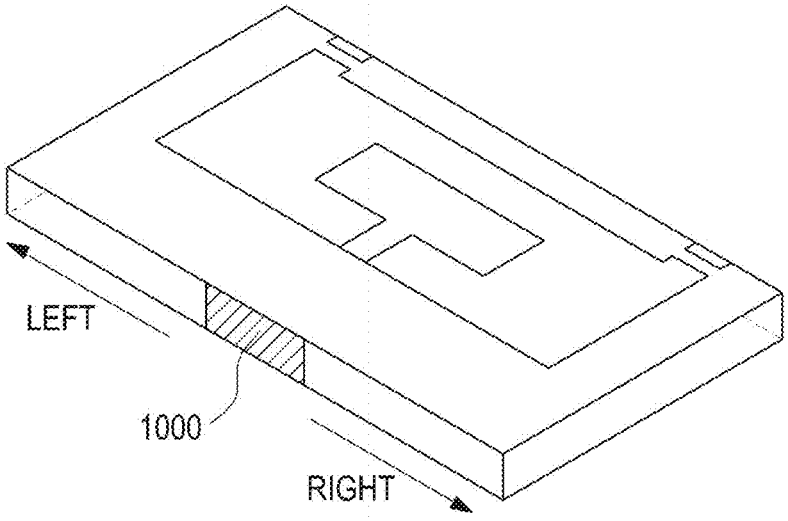
FIG. 10 illustrates a connection unit for connecting a top face of an antenna to a bottom face thereof according to an embodiment of the present disclosure.

FIG. 10 illustrates a connection unit for connecting a top face of an antenna to a bottom face thereof according to an embodiment of the present disclosure.

Referring to FIG. 10, a connection unit 1000 for connecting an RF ground on a top face of the antenna to an RF ground on a bottom face of the antenna may be disposed on a side face of the antenna. The connection unit 1000 may be used to implement a switching function capable of reconfiguring the antenna pattern. A detailed description thereof will be made with reference to FIGS. 11A and 11B.

Figure 11A:
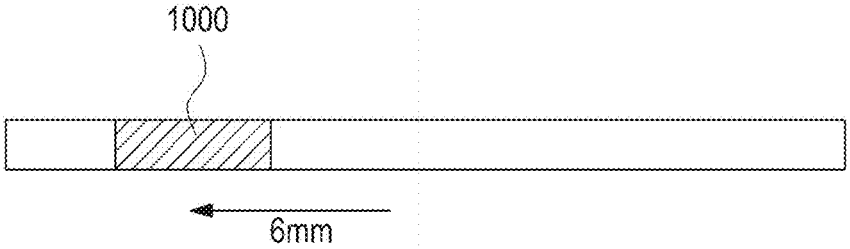
FIGS. 11A and 11B illustrate a position of a connection unit, which is changed for a switching function, according to an embodiment of the present disclosure.
Figure 11B:
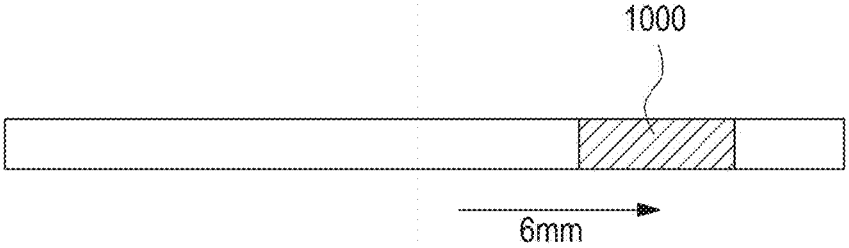

FIGS. 11A and 11B illustrate a position of a connection unit which is changed for a switching function according to an embodiment of the present disclosure.

Referring to FIG. 11A, if the position of the connection unit 1000 moves from a central position of the side face of the antenna towards a left direction by a preset distance, size, or length, e.g., 6 mm, the pattern, e.g., radiation direction, of the antenna may be changed from an existing direction to the left direction.

Referring to FIG. 11B, if the position of the connection unit 1000 moves from the central position of the side face of the antenna towards a right direction by a preset distance, size, or length, e.g., 6 mm, the pattern, e.g., the radiation direction of the antenna may be changed from the existing direction to the right direction.

Figures 12A, 12B, 12C:
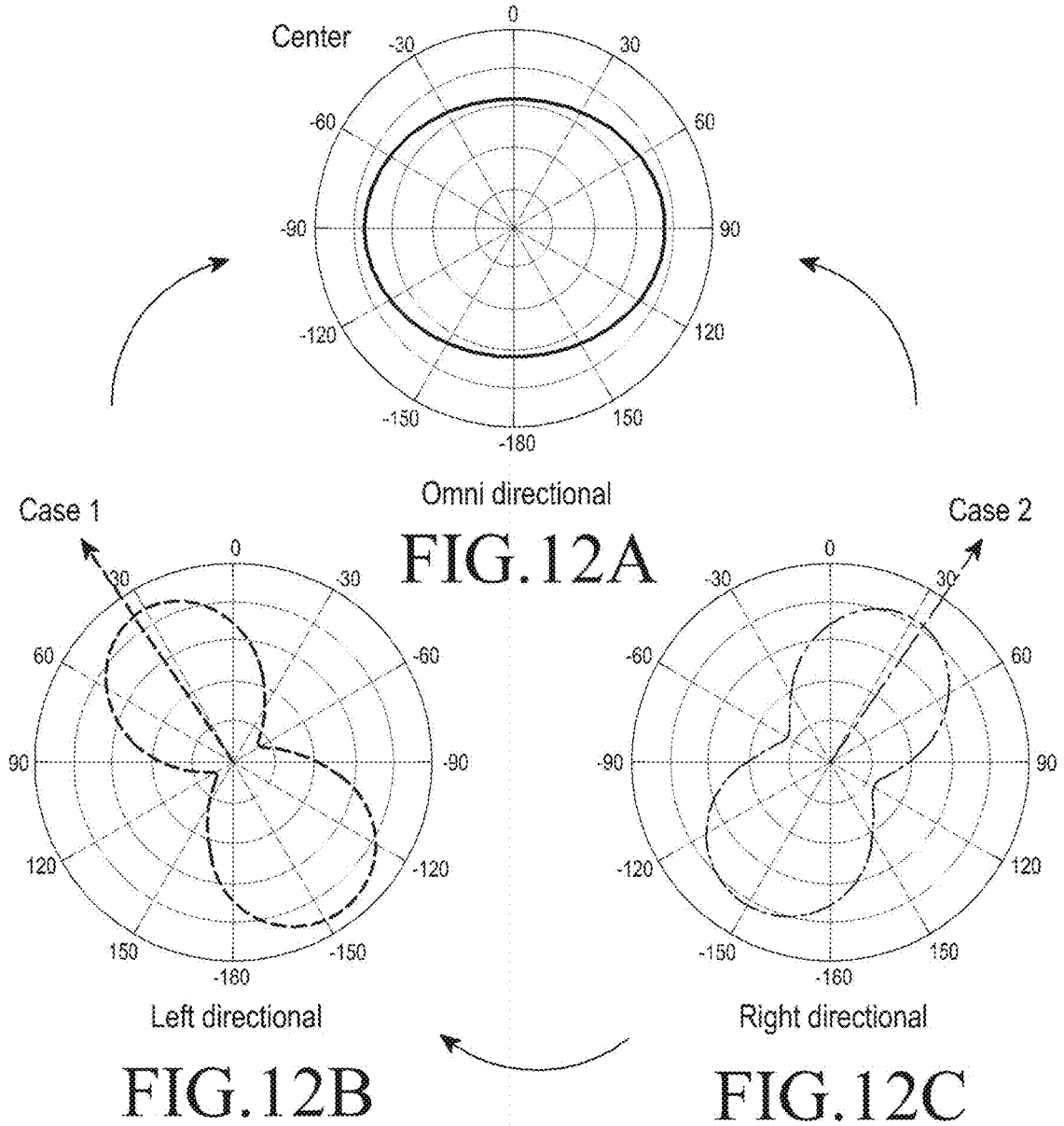
FIGS. 12A, 12B, and 12C illustrate antenna patterns based on changes in position of a connection unit according to an embodiment of the present disclosure.

Specifically, the antenna patterns based on the changes in position of the connection unit 1000 is as illustrated in FIGS. 12A to 12C.

FIGS. 12A to 12C illustrate antenna patterns based on changes in position of a connection unit according to an embodiment of the present disclosure.

Referring to FIG. 12A, a pattern of an antenna when the connection unit 1000 is situated in the exact center and/or at approximately the exact center of the side face of the antenna is illustrated. Referring to FIG. 12A, it can be noted that if the connection unit 1000 is situated in the exact center of the side face of the antenna, the radiation direction of the antenna may be omni-directional, and the antenna may have the omni-directional characteristics.

Referring to FIG. 12B, a pattern of an antenna when the position of the connection unit 1000 moves from the central position of the side face of the antenna to the left by a preset distance, size, or length, as illustrated in FIG. 11A, is illustrated. As illustrated in FIG. 12B, it can be noted that if the position of the connection unit 1000 moves to the left by the preset distance, size, or length, the radiation direction of the antenna is biased to the left.

Referring to FIG. 12C, a pattern of an antenna when the position of the connection unit 1000 moves from the central position of the side face of the antenna to the right by a preset distance, size, or length, as illustrated in FIG. 11B, is illustrated. As illustrated in FIG. 12C, it can be noted that if the position of the connection unit 1000 moves to the right by the preset distance, size, or length, the radiation direction of the antenna is biased to the right.

The antenna patterns as illustrated in FIGS. 12A to 12C may be selectively used depending on the position of the connection unit 1000.

Figure 13:
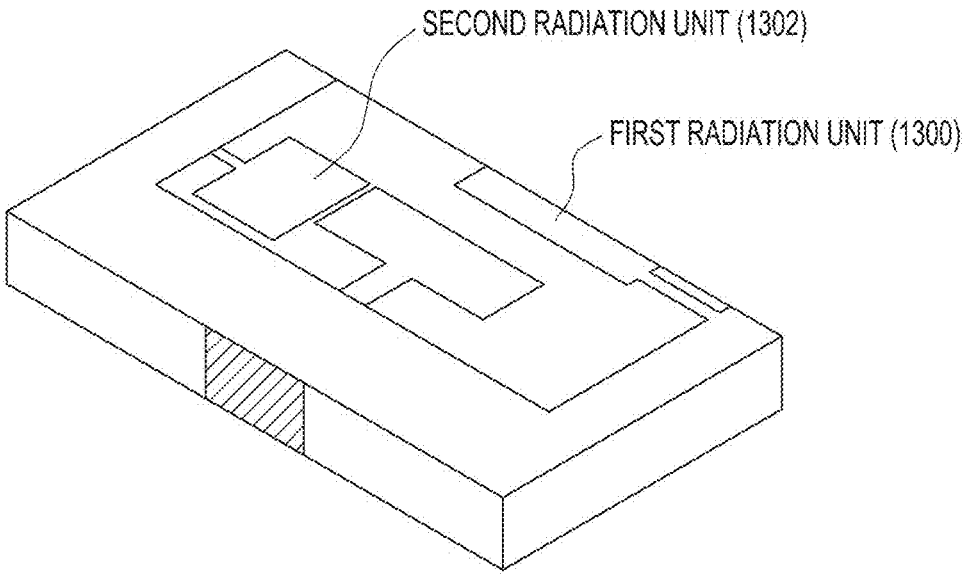
FIG. 13 illustrates an antenna with a radiation unit additionally configured thereon according to an embodiment of the present disclosure.

FIG. 13 illustrates an antenna with a radiation unit additionally configured thereon according to an embodiment of the present disclosure.

Referring to FIG. 13, in an embodiment of the present disclosure, an antenna may further include at least one radiation unit. For example, as illustrated in FIG. 13, the antenna may include a second radiation unit 1302 as a parasitic radiation unit, in addition to a first radiation unit 1300 that has the same form as that of the radiation unit 104 illustrated in FIG. 1. The second radiation unit 1302 may transmit signals using a frequency band different from that of the first radiation unit 1300. Accordingly, if the second radiation unit 1302 is additionally used, the antenna bandwidth may be extended, contributing to an increase in antenna efficiency. The antenna illustrated in FIG. 13 may have a same structure as that of the above-described antenna in FIG. 1, except that the second radiation antenna 1302 is additionally included in the antenna of the embodiment of FIG. 13.

Figure 14:
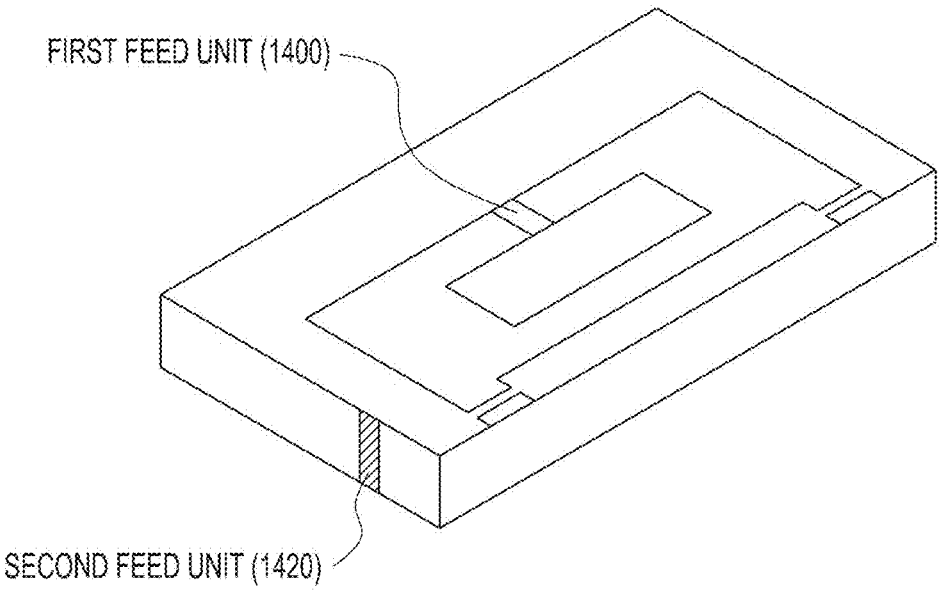
FIG. 14 illustrates an antenna including a plurality of feed units according to an embodiment of the present disclosure.

FIG. 14 illustrates an antenna including a plurality of feed units according to an embodiment of the present disclosure.

Referring to FIG. 14, in an embodiment of the present disclosure, an antenna may include a plurality of feed units. For example, the antenna may include a first feed unit 1400 for horizontal radiation and a second feed unit 1420 for vertical radiation. The antenna may be configured in a form in which one feed line for the second feed unit 1420 is added to the antenna illustrated in FIG. 1.

The first feed unit 1400 and the second feed unit 1420 may be selectively used. In other words, one of the first feed unit 1400 and the second feed unit 1420 may be selected and used by an RF chip depending on the signal strength thereof. The selected feed unit may have the higher signal strength. If one feed unit is selected and turned on, another feed unit may be turned off, and the first feed unit 1400 and the second feed unit 1420 may be used in a switched way, or in other words may be alternatively used.

Figure 15A:
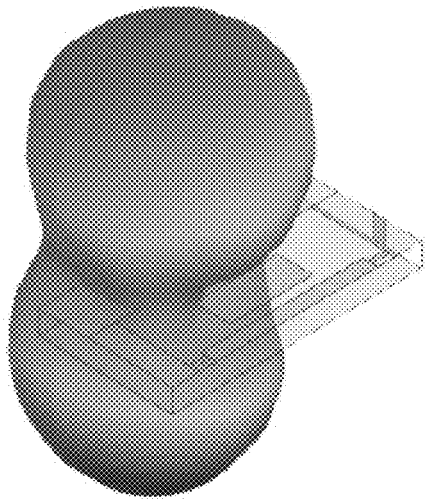
FIGS. 15A and 15B illustrate vertical radiation and horizontal radiation occurring from an antenna according to an embodiment of the present disclosure.
Figure 15B:
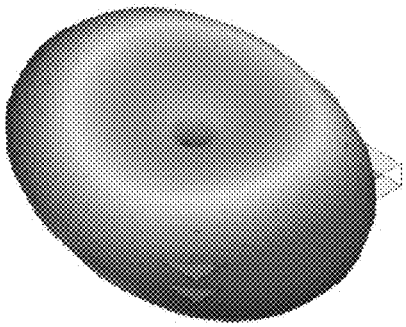

Radiation patterns of the first feed unit 1400 and the second feed unit 1420 are as illustrated in FIGS. 15A and 15B.

FIGS. 15A and 15B illustrate vertical radiation and horizontal radiation occurring from an antenna according to an embodiment of the present disclosure.

Referring to FIG. 15A, a case in which vertical radiation of an antenna, which occurs if the second feed unit 1420 is selected, is illustrated. Referring to FIG. 15B, a case in which horizontal radiation of an antenna, which occurs if the first feed unit 1400 is selected, is illustrated.

As such, in an embodiment of the present disclosure, the horizontal radiation and also the vertical radiation may be achieved by adding one feed line to one antenna, thereby making it possible to increase an operation coverage, or in other words, an operational area and/or coverage area, of the antenna with the simple and small structure.

Figure 16:
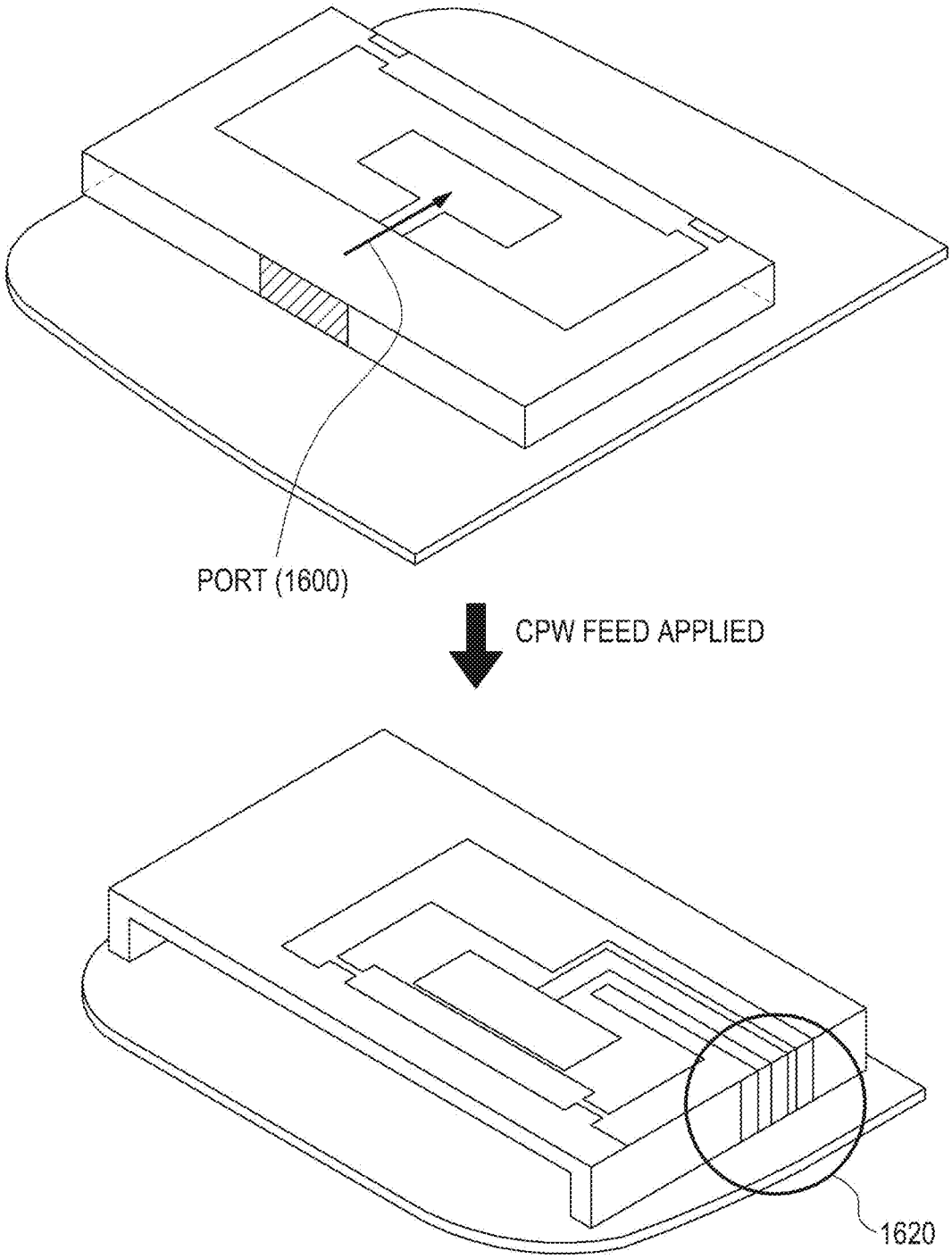
FIG. 16 illustrates an antenna including a Coplanar Wave Guide (CPW) feed line according to an embodiment of the present disclosure.

FIG. 16 illustrates an antenna including a Coplanar Wave Guide (CPW) feed line according to an embodiment of the present disclosure.

Referring to FIG. 16, the planar antenna described in conjunction with FIG. 1 may be attached to a Printed Circuit Board (PCB), a metal or the like. In this case, if the antenna is in close proximity to the PCB, the metal or the like, the antenna efficiency and performance may be degraded. Taking this into consideration, a CPW feed line 1620 may be used, as illustrated in FIG. 16.

The CPW feed line 1620 is used to perform feeding by using the PCB and/or the metal as a part of the antenna, so the CPW feed line 1620 may prevent the decrease in energy radiation efficiency, which is caused as power is applied through a port 1600.

Figure 17:
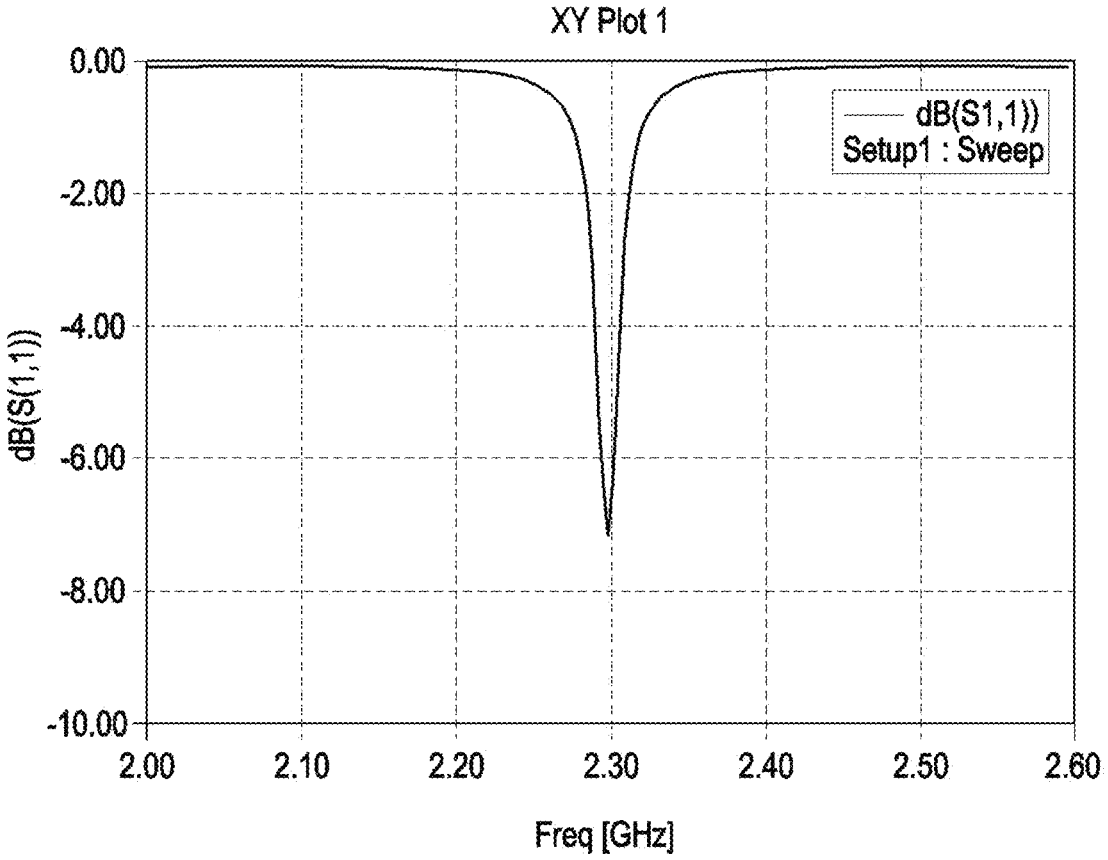
FIG. 17 illustrates an operating frequency of an antenna including a CPW feed line according to an embodiment of the present disclosure.
Figure 17:
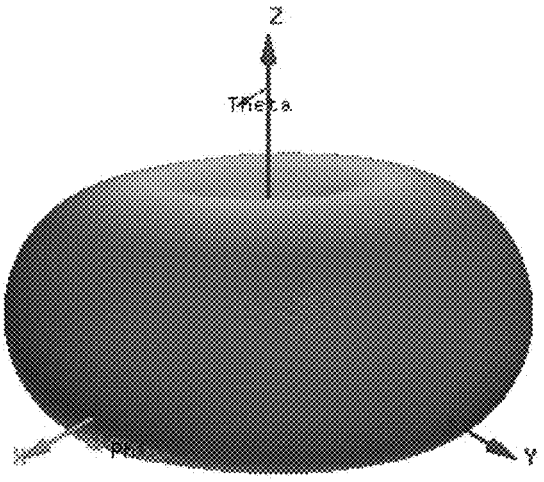

FIG. 17 illustrates an operating frequency of an antenna including a CPW feed line according to an embodiment of the present disclosure.

Referring to FIG. 17, it can be noted that if the CPW feed line 1620 is used, the operating frequency of the antenna may be kept at 2.3 GHz. In other words, during feeding, the horizontal radiation characteristics of the antenna may be kept constant.

If the CPW feed line 1620 is used, an odd mode, in which the direction of charges is opposed, may occur in the feed line, and an electric field of a signal may be distributed in an opposite direction. Taking these problems into consideration, an air-bridge may be applied to the antenna.

Figure 18A:
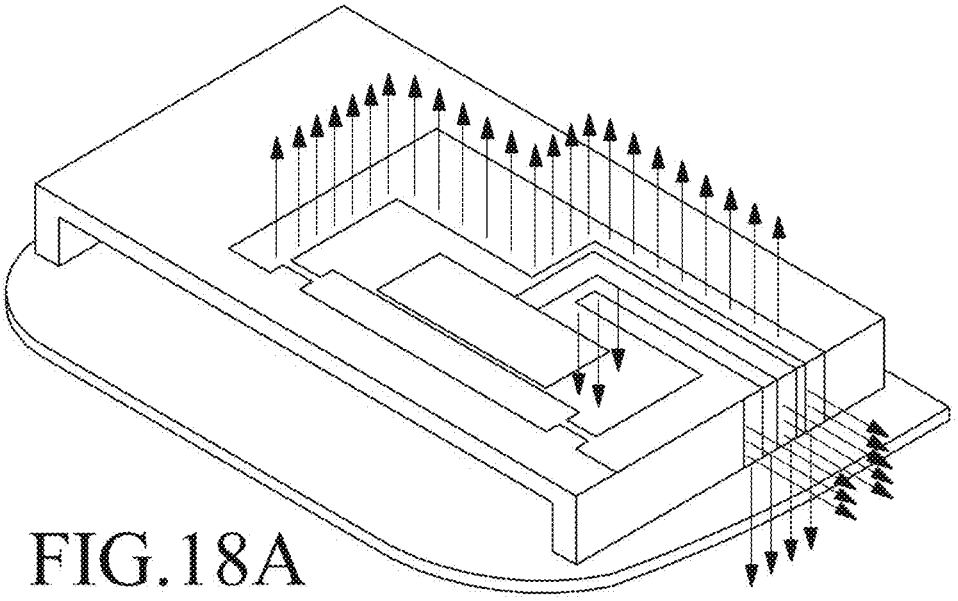
FIGS. 18A and 18B illustrate an antenna that uses an air-bridge according to an embodiment of the present disclosure.
Figure 18B:
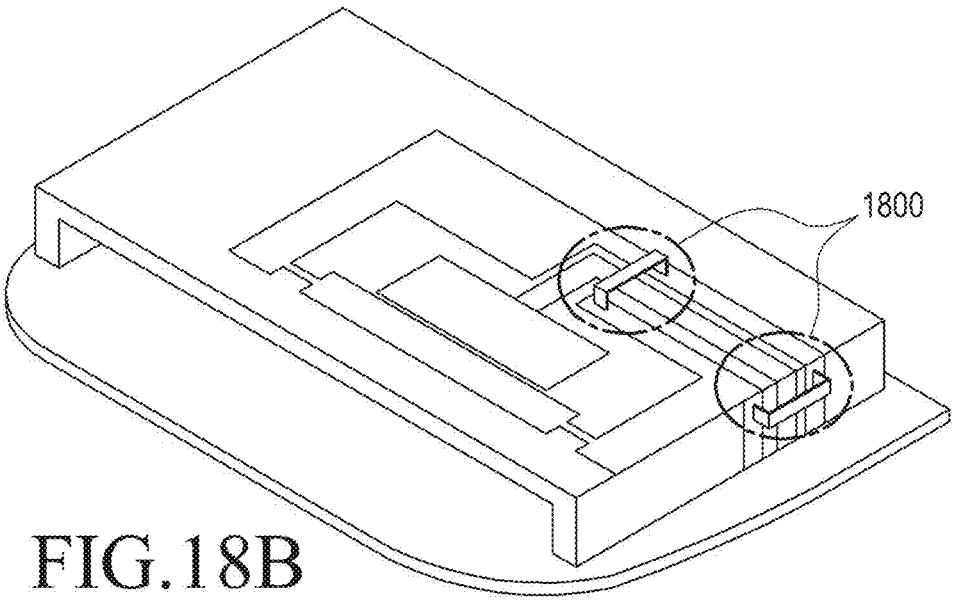

FIGS. 18A and 18B illustrate an antenna that uses an air-bridge according to an embodiment of the present disclosure.

Referring to FIGS. 18A and 18B, if an odd mode occurs in a CPW feed line, as illustrated in FIG. 18A, an air-bridge 1800 may be added to the CPW feed line, as illustrated in FIG. 18B. If the air-bridge 1800 is added, an even mode may occur, in which all signals on the CPW feed line have a same phase and a potential difference is eliminated. Accordingly, the antenna efficiency may increase, and a detailed description thereof will be made with reference to FIG. 19.

Figure 19:
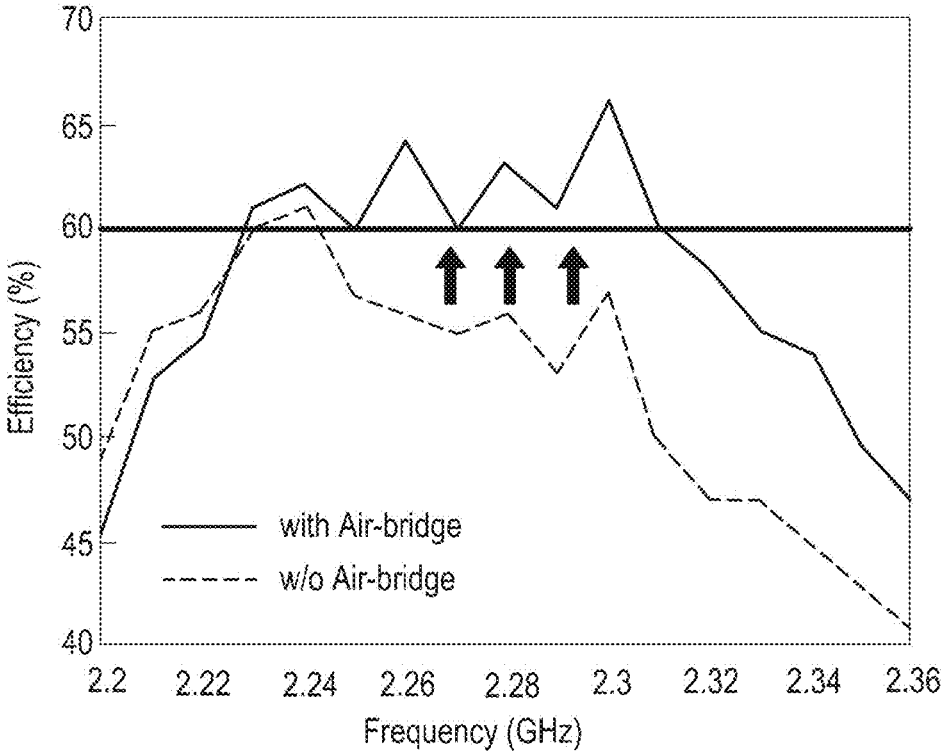
FIG. 19 is a graph illustrating an efficiency of an antenna that uses an air-bridge according to an embodiment of the present disclosure.

FIG. 19 is a graph illustrating an efficiency of an antenna that uses an air-bridge according to an embodiment of the present disclosure.

Referring to FIG. 19, it can be noted that if an air-bridge is used in an antenna, all directions of electric fields in a ground field may be changed to a same direction, so the efficiency may be higher compared to when the air-bridge is not used. If an air-bridge is used in the antenna in, for example, a 100 MHz band, the antenna may have an efficiency which is higher by 10% on average, compared with when the air-bridge is not used.

Although not illustrated in the drawings, in an embodiment of the present disclosure, as for the antenna, a plurality of antennas may be additionally used in various forms such as being configured in an array form.

Figure 20:
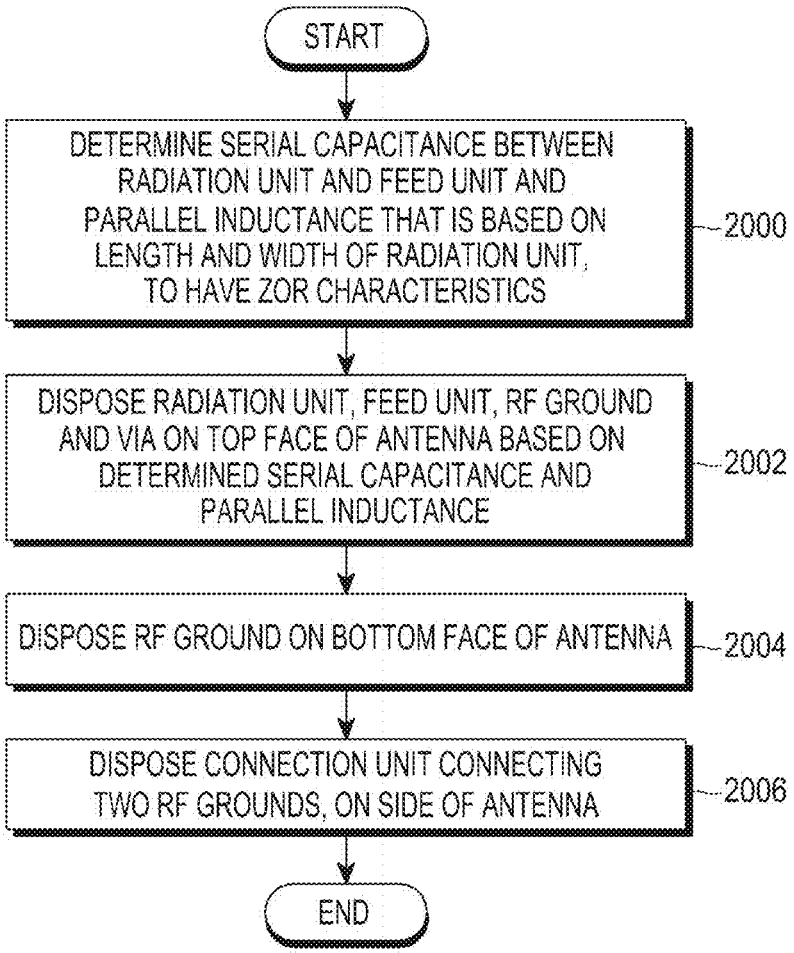
FIG. 20 is a flowchart illustrating a process of configuring an antenna according to an embodiment of the present disclosure.

FIG. 20 is a flowchart illustrating a process of configuring an antenna according to an embodiment of the present disclosure.

The process in FIG. 20 will be described with reference to FIG. 1. In operation 2000, a serial capacitance value between the radiation unit 104 and the feed unit 102 and a parallel inductance value based on a length and a width of the radiation unit 104 may be determined to have ZOR antenna characteristics. In operation 2002, based on the determined serial capacitance value and parallel inductance value, the radiation unit 104, the feed unit 102, the RF ground 100 and the via 106 may be disposed on a top face of the antenna. In operation 2004, the RF ground 110 may be disposed on the bottom face of the antenna. In operation 2006, the connection unit 109, for connecting the two RF grounds 100 and 110, may be disposed on the side face of the antenna. If the antenna is configured as described above, signals may be transmitted in a form in which the signals are horizontally radiated.

As is apparent from the foregoing description, a planar antenna proposed in the present disclosure has a planar structure, enables horizontal radiation, and may increase antenna efficiency at low cost. In addition, the planar antenna may adjust the horizontal radiation direction and extend an antenna bandwidth. Besides, the planar antenna may be configured to be ultra-thin, since the planar antenna has a volume of less than half when compared to the related-art antenna. Therefore, the planar antenna may be mounted on a variety of wireless communication devices which are getting slim, such as cellular terminals, TVs and the like. In addition, the antenna may increase price competitiveness and maximize mass production because the antenna can be produced at low cost.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna apparatus comprising:

a first radiation unit configured to radiate a signal;

a first feed unit configured to apply the signal to be transmitted to the first radiation unit;

a first radio frequency (RF) ground to which a plurality of antenna elements are grounded;

a via that connects the first radiation unit to the first RF ground, the first radiation unit, the first feed unit, the first RF ground, and the via being disposed on a first plane;

a second RF ground disposed on a second plane existing in a position parallel to the first plane; and a connection unit configured to connect the first RF ground to the second RF ground, the connection unit being disposed on a third plane connecting the first plane to the second plane, wherein a separation distance between the first feed unit and the first radiation unit is configured to provide a predetermined serial capacitance value between the first radiation unit and the first feed unit, wherein a length and a width of the first radiation unit are configured to provide a predetermined parallel inductance value of the first radiation unit, wherein the predetermined serial capacitance value and the predetermined parallel inductance value are configured to cause a resonant frequency in a predetermined frequency band to be a preset value, and wherein a radiation direction of the signal is determined based on a position of the connection unit disposed on the third plane, and the position of the connection unit is variable on the third plane and changed to adjust the radiation direction of the signal.

2. The antenna apparatus of claim 1, wherein the radiation direction of the signal is an omni-direction if the position of the connection unit is a center in the third plane, wherein the radiation direction of the signal is a right-direction if the position of the connection unit is a position apart from the center in the third plane by a preset value to a right, and wherein the radiation direction of the signal is a left-direction if the position of the connection unit is a position apart from the center in the third plane by a preset value to a left.

3. The antenna apparatus of claim 1, wherein the first plane corresponds to a first face from among six faces constituting a hexahedron, wherein the second plane corresponds to a second face, from among the six faces, existing in a position parallel to the first plane, and wherein the third plane corresponds to a third face, from among the six faces, connecting the first plane to the second plane.

4. The antenna apparatus of claim 1, further comprising a second radiation unit configured to transmit a signal using a frequency band different from a frequency band used by the first radiation unit, wherein the second radiation unit is disposed on the first plane.

5. The antenna apparatus of claim 1, further comprising a second feed unit configured to change a radiation pattern of the first radiation unit based on a feed line situated on a fourth plane that is connected perpendicular to the first plane.

6. The antenna apparatus of claim 5, wherein the feed line is a coplanar wave guide (CPW) feed line.

7. The antenna apparatus of claim 6, wherein an air-bridge causing all electric fields of a signal to have a same direction is added to the CPW feed line.

8. The antenna apparatus of claim 7, wherein the CPW feed line is connected to at least one of a printed circuit board (PCB) and a metal substrate.

9. The antenna apparatus of claim 5, wherein, if one of the first feed unit and the second feed unit is turned on, then another one of the first feed unit and the second feed unit is turned off.

10. The antenna apparatus of claim 1, wherein the preset value is zero.

11. A method for transmitting a signal, the method comprising:

radiating a signal using an antenna, wherein the antenna includes a first radiation unit configured to transmit the signal, a first feed unit configured to apply the signal to be transmitted to the first radiation unit, a first radio frequency (RF) ground to which a plurality of antenna elements are grounded, a via that connects the first radiation unit to the first RF ground, the first radiation unit, the first feed unit, the first RF ground, and the via being disposed on a first plane, a second RF ground disposed on a second plane existing in a position parallel to the first plane, and a connection unit configured to connect the first RF ground to the second RF ground, the connection unit being disposed on a third plane connecting the first plane to the second plane, wherein a separation distance between the first feed unit and the first radiation unit is configured to provide a predetermined serial capacitance value between the first radiation unit and the first feed unit, wherein a length and a width of the first radiation unit are configured to provide a predetermined parallel inductance value of the first radiation unit, wherein the predetermined serial capacitance value and the predetermined parallel inductance value are configured to cause a resonant frequency in a predetermined frequency band to be a preset value, and wherein a radiation direction of the signal is determined based on a position of the connection unit disposed on the third plane, and the position of the connection unit is variable on the third plane and changed to adjust the radiation direction of the signal.

12. The method of claim 11, wherein the radiation direction of the signal is an omni-direction if the position of the connection unit is a center in the third plane, wherein the radiation direction of the signal is a right-direction if the position of the connection unit is a position apart from the center in the third plane by a preset value to a right, and wherein the radiation direction of the signal is a left-direction if the position of the connection unit is a position apart from the center in the third plane by a preset value to a left.

13. The method of claim 11, wherein the first plane corresponds to a first face from among six faces constituting a hexahedron, wherein the second plane corresponds to a second face, from among the six faces, existing in a position parallel to the first plane, and wherein the third plane corresponds to a third face, from among the six faces, connecting the first plane to the second plane.

14. The method of claim 11, further comprising transmitting, by a second radiation unit, another signal using a frequency band different from a frequency band used by the first radiation unit, wherein the second radiation unit is disposed on the first plane.

15. The method of claim 11, further comprising changing, by a second feed unit, a radiation pattern of the first radiation unit based on a feed line situated on a fourth plane that is connected perpendicular to the first plane.

16. The method of claim 15, wherein the feed line is a coplanar wave guide (CPW) feed line.

17. The method of claim 16, further comprising causing all of electric fields of a signal to have a same direction using an air bridge that is added to the CPW feed line.

18. The method of claim 17, wherein the CPW feed line is connected to at least one of a printed circuit board (PCB) and a metal substrate.

19. The method of claim 15, wherein, if one of the first feed unit and the second feed unit is turned on, another one of the first feed unit and the second feed unit is turned off.

20. The method of claim 11, wherein the preset value is zero.

* * * * *